United States Patent [19]

Wilkins et al.

[11] 4,094,034

[45] June 13, 1978

[54] FLOOR TREATMENT MACHINES

[75] Inventors: John Thomas Wilkins, Bushey Heath; Haydn Frank Mayo, Hazlemere, both of England

[73] Assignee: R. G. Dixon & Company Limited, Wembley, England

[21] Appl. No.: 773,843

[22] Filed: Mar. 2, 1977

[30] Foreign Application Priority Data

Mar. 4, 1976 United Kingdom ..... 8742/76

[51] Int. Cl.[2] ..... A47L 11/162

[52] U.S. Cl. ..... 15/49 R; 51/177

[58] Field of Search ..... 15/28, 29, 49 R, 50 R, 15/52, 98, 385; 51/170 T, 177

[56] References Cited

U.S. PATENT DOCUMENTS

| | | | |
|---|---|---|---|
| 3,098,329 | 7/1963 | Doran | 51/177 |
| 3,122,765 | 3/1964 | Magarian | 15/49 R |

FOREIGN PATENT DOCUMENTS

| | | | |
|---|---|---|---|
| 382,892 | 11/1932 | United Kingdom | 51/177 |

*Primary Examiner*—Edward L. Roberts
*Attorney, Agent, or Firm*—Michael J. Striker

[57] ABSTRACT

A floor treatment machine of the rotary brush type in which, in operation, the weight of the machine is, to at least a significant extent, supported by the rotary brush or brushes, in which a brush mounting member is flexibly suspended between resilient elements for limited universal movement.

14 Claims, 2 Drawing Figures

Figures 1, 2:
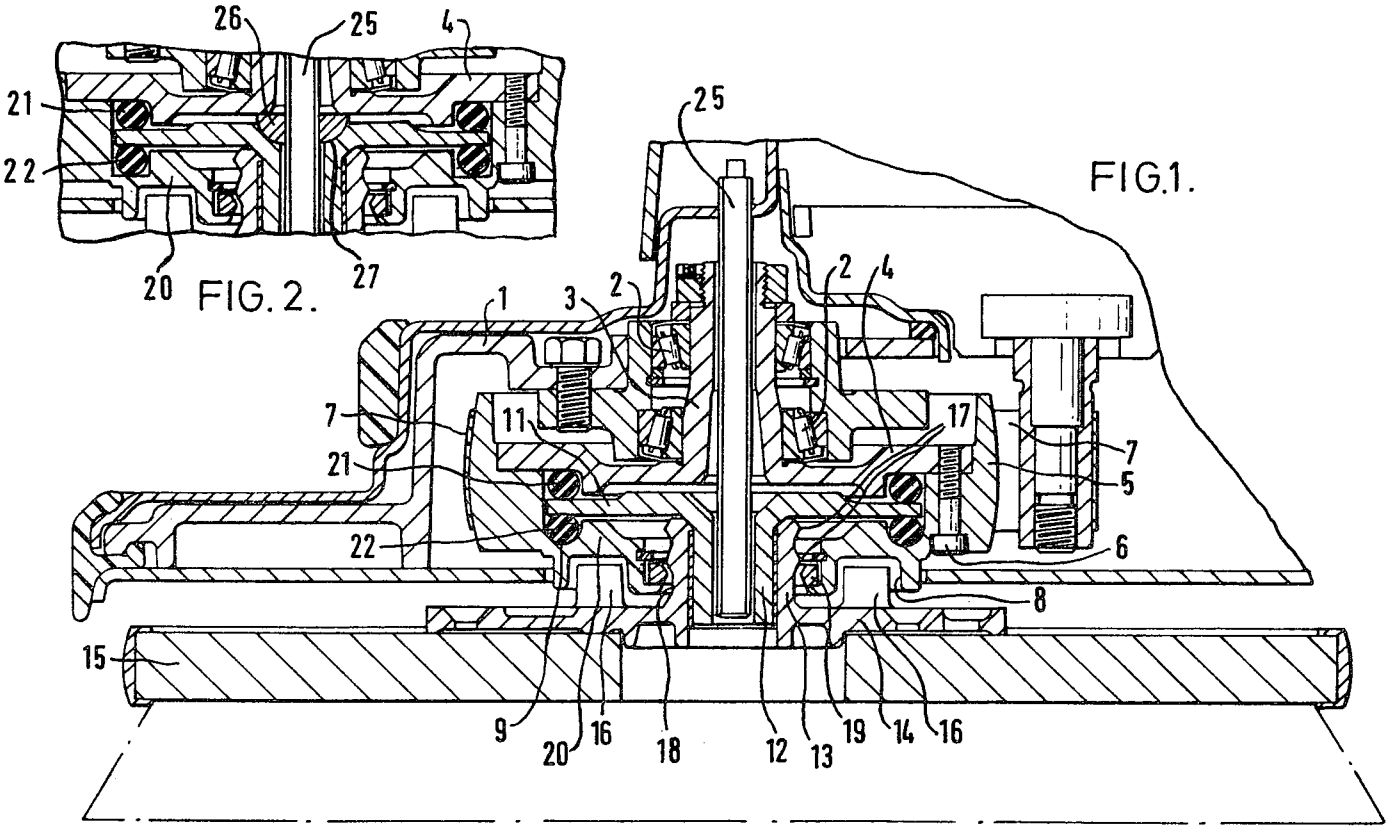

1
2
3
4
5
6
7
8
9
11
12
13
14
15
16
17
18
19
20
21
22
25
26
27

FLOOR TREATMENT MACHINES

This invention relates to floor treatment machines of the rotary brush type in which the weight of the machine is supported by the rotary brush or brushes.

The expression "brush" as herein used should be deemed to include polishing or buffing pads in addition to scrubbing or polishing brushes.

In such machines vibration of the machine may arise when the brush wobbles in operation, e.g. if the plane of the bristle tips or surface in engagement with the floor is not exactly perpendicular to the axis of rotation.

In order to overcome this, it has previously been proposed to introduce a degree of flexibility into the final drive coupling to the brush, for example by having a rubber cushion between the brush back and the final drive shaft. However, the considerable preloading due to the machine weight leads to some lack of consistency in operation and difficulties in ensuring that wobbles over a range of intensity can be absorbed satisfactorily.

According to the present invention, there is provided a floor treatment machine of the rotary brush type in which a brush mounting member is flexibly suspended between resilient elements for limited universal movement.

Preferably, the resilient elements are upper and lower resilient rings of substantially similar stiffness.

In an arrangement in which one of the rings normally transmits the weight of the machine to the mounting member, the other ring may be stiffened by the geometry of its seating to bring the rings into substantial similarity of stiffness.

The invention will be further described with reference to the accompanying drawings, in which:

FIG. 1 is a sectional view through a brush and final drive train of a preferred form of machine according to the present invention; and FIG. 2 is a scrap section showing a modification of FIG. 1.

FIG. 1 shows part of a machine chassis 1 which supports, by means of bearings 2, a hollow shaft 3 having a flange 4 to which is secured a final drive pulley 5 by means of bolts 6. The shaft 3 is received over a static pilot sleeve shaft 25. Drive is transmitted to the pulley 5 by means of a belt shown at 7. The pulley 5 has an annular series of holes 8, and an annular seat 9.

A brush support member consists of a flange 11 and a spigot 12 which is received within a socket in an upstanding boss 13 forming part of a brush adapter plate 14 which is screwed to the back of a conventional brush 15. The adapter plate 14 also carries upstanding dogs 16 cooperable with the annular series of holes 8 to provide a drive connection between the pulley 5 and the brush 15. The outer surface of the boss 13 is provided with parallel ribs 17 defining two cavities 18 adapted to receive a spring clip 19 located in a recess in the pulley 5. The engagement of the clip 19 in either cavity 18 prevents the brush from falling from the machine when it is clear of the ground while the machine is being carried on transport wheels, while allowing the brush to be removed by a sharp tug.

Attention is drawn to our co-pending application filed simultaneously herewith and entitled "Improvements in or relating to brush retention means for floor treating machines".

The flange 11 of the brush mounting member extends between the flange 4 and an inwardly extending flange 20 of the pulley 5 and is supported between upper and lower rubber rings 21 and 22 respectively, each being of O section and having similar flexibility characteristics.

The weight of the machine is transmitted to the brush retention member through the upper ring 21, which is thus effectively somewhat stiffer than the ring 22, but this difference is compensated by the curvature of the seat 9 provided in the pulley 5 for retention of the ring 22, the effect of this curved seating being to increase the stiffness of the ring 22.

It will be appreciated that if the stiffnesses of the rings 21 and 22 are not effectively the same, rocking of the brush 15 will give rise to some vertical motion of the machine. This phenomenon arises from the fact that an upward motion of one side of the flange 11 gives rise to an equal and opposite motion of the opposite side of the flange 11 and unless these movements are resisted by rings of similar stiffness, there will be a net vertical motion of the machine itself.

It will be appreciated that it may prove, in certain circumstances, necessary to have the ring 22 made of stiffer material or of different shape to ring 21 to compensate for the fact that the ring 21 is normally under very considerable pressure arising from the weight of the machine.

In the modification shown in FIG. 2, there is provided a part spherical bearing surface 26 mounted on the pilot shaft 25 and cooperable with a concave bearing surface 27 in the brush support member. This arrangement acts as a swivel thrust bearing to transfer the weight of the machine onto the brush while allowing the brush to wobble in operation. The rubber rings 21 and 22 have only to provide resilience to counteract the tilt of the machine. They can therefore be more resilient than if they have to transmit weight and provide better isolation. The seats for the rings 21 and 22 may then be of similar configuration as shown.

Various other modifications may be made within the scope of the invention.

We claim:

1. A floor treating machine comprising in combination:

a chassis;

a drive element within said chassis;

means for rotating said drive element only about a vertical axis passing through said chassis;

a brush mounting member adjacent said drive element and jointly rotatable therewith, said brush mounting member having a substantially horizontal flange provided with an upper and a lower side;

a plurality of resilient elements carried on said drive element engaging said brush mounting member on said upper and lower sides thereof and suspending said brush mounting member on said drive element for limited rocking of said brush mounting member relative to said drive element; and a brush fixed to said brush mounting member and jointly displaceable therewith, whereby said brush rotates about the vertical axis passing through the chassis while rocking about the axis so as to maximize engagement of said brush with a floor surface.

2. The machine of claim 1, said plurality of resilient elements being resilient rings of substantially similar stiffness.

3. The machine of claim 2, the vertical axis passing through approximately the center of said chassis and being defined by a pilot shaft, said brush support member having a concave bearing surface; and further comprising a semi-spherical bearing mounted on the pilot shaft and cooperable with the concave bearing surface of said brush support member, said semi-spherical bearing, the pilot shaft and the concave bearing forming an arrangement which acts as a swivel thrust bearing which transfers the weight of the machine to said brush while said brush rocks unimpeded about the vertical axis.

4. The machine of claim 2, said resilient rings comprising at least one pair of such rings which engage said upper and lower sides of said brush mounting member, one ring of the pair being arranged to transmit the weight of the machine to said brush to thereby rock said brush relative to the vertical axis passing through the chassis, and to incidentally stiffen the one ring, and the other ring of the pair being pressed against said drive element in such a manner as to be compensatorily stiffened so as to bring the rings of said pair into substantially similar stiffness, whereby the rings of each pair are maintained in substantially similar stiffness so that rocking of said brush is not accompanied by a vertical motion of the machine, the vertical motion being resisted by the similarly stiff rings.

5. The machine of claim 4, said drive element including a drive pulley, the resilient rings being carried by the drive pulley.

6. The machine of claim 5, further comprising a substantially upright boss connected to said brush and being slidably mounted on said brush mounting member; and spring clip means connected to said drive element for pressing against an outer surface portion of said boss so as to prevent inadvertent removal of said brush from said brush mounting member.

7. The machine of claim 6, said boss having at least one circumferential recess, and said spring clip means being mounted on a rotary part of said drive element and cooperating with the circumferential recess on said boss.

8. The machine of claim 7, said chassis including an upright tube and bearings; said drive element including a drive pulley with an inwardly extending flange having an upper face defining an annular seat against which the other ring of said resilient elements is pressed so as to compensatorily stiffen it, and a lower face defining an annular series of holes, the inwardly extending flange also defining a recess in which said spring clip means is located, said drive element also including a hollow shaft defining the vertical axis, being supported by the bearings and fixed to the drive pulley while being received over the upright tube; and said rotating means including a belt connecting the drive pulley to a source of power for rotating the drive pulley and the thereto fixed hollow shaft about the vertical axis.

9. The machine of claim 9, the hollow shaft having at least two portions, one portion extending generally along the vertical axis and the other portion extending radially outwardly and generally perpendicularly from both the vertical axis and the one portion, the hollow shaft being connected to the drive pulley through the other portion.

10. The machine of claim 9, said brush mounting member having two portions, one portion being said flange and extending substantially radially outwardly from the vertical axis and the other portion being a tubular portion extending below said flange substantially parallel to the vertical axis and being received in the circumferential recess of said boss; and further comprising a brush adaptor plate fixed to the back of said brush, said brush adaptor plate carrying said boss, said boss being provided with an outer surface having substantially parallel ribs defining at least two cavities each being adapted to receive said spring clip means so as to removably connect said brush to said drive pulley, said brush adaptor plate also carrying a plurality of upright dogs cooperable with the annular series of holes on the lower face of the inwardly extending flange of said drive pulley for joint rotation of said brush with said drive pulley.

11. The machine of claim 10, said flange of said brush mounting member extending between the inwardly extending flange of the drive pulley and the radially outwardly extending other portion of the hollow shaft.

12. The machine of claim 11, said plurality of resilient elements being two resilient rings, one ring being arranged between the inwardly extending flange of the drive pulley and said flange of said brush mounting member, the other ring being arranged between the radially outwardly extending other portion of the hollow shaft and said flange of said brush mounting member.

13. The machine of claim 12, the two resilient rings having a circular cross section and being of similar flexibility, wherein said flange of said brush mounting member is free from any other connection respectively to said drive pulley and to the hollow shaft, and wherein said rings, the portions of the hollow shaft, the drive pulley and its inwardly extending flange and its annular seat, said flange and said tubular portion of said brush mounting member, and said boss are circumferentially arranged about the vertical axis.

14. The machine of claim 8, the annular seat of said drive pulley being curved in such a manner as to increasingly stiffen the other ring of said resilient elements when the other ring is pressed against the annular seat.

* * * * *